US005115947A

United States Patent [19]

McDonnell et al.

[11] Patent Number: 5,115,947

[45] Date of Patent: May 26, 1992

[54] COLLAPSIBLE WATER TANK

[75] Inventors: William J. McDonnell, Clinton; Alexander C. Sarnacki, Jr., Utica, both of N.Y.; Dean E. Collins, Lowell, Mich.

[73] Assignee: D. B. Smith & Co., Inc., Utica, N.Y.

[21] Appl. No.: 352,557

[22] Filed: May 16, 1989

[51] Int. Cl.[5] ..... B67D 5/64

[52] U.S. Cl. ..... 222/107; 222/175; 222/527; 224/148; 141/18; 141/111; 383/105; 383/33; 169/33

[58] Field of Search ..... 222/175, 92, 105, 107, 222/209, 527, 528; 383/33, 26, 27, 105-108, 905; 224/148, 153, 209, 259; 141/18, 23, 24, 110, 111, 114, 312, 313; 169/33

[56] References Cited

U.S. PATENT DOCUMENTS

| | | | |
|---|---|---|---|
| 177,749 | 5/1876 | Redden . | |
| 411,954 | 10/1889 | Eggers . | |
| 516,097 | 3/1894 | King et al. | 383/33 X |
| 745,421 | 12/1903 | Cushing . | |
| 1,074,269 | 9/1913 | Kepler . | |
| 1,619,120 | 3/1927 | Heaton | 222/175 X |
| 1,902,548 | 3/1933 | Fenwick, Jr. | 222/175 X |
| 2,013,358 | 9/1935 | Osborne | 222/175 X |
| 2,170,364 | 8/1939 | Bergstein . | |
| 2,415,956 | 2/1947 | Mamaux . | |
| 2,512,448 | 6/1950 | Tattersall . | |
| 3,154,238 | 2/1964 | Barnhill . | |
| 3,711,011 | 1/1973 | Kugler . | |
| 3,865,304 | 2/1975 | Mojonnier et al. | 383/905 X |
| 4,090,542 | 5/1978 | Hacker, Jr. | 383/33 X |
| 4,144,607 | 3/1979 | Soubie | 224/148 X |
| 4,191,232 | 4/1980 | Szabo . | |
| 4,235,365 | 11/1980 | Yoshii et al. . | |
| 4,356,954 | 11/1982 | Mojonnier | 383/905 X |
| 4,603,432 | 7/1986 | Marino . | |
| 4,672,688 | 6/1987 | Kalkipsakis . | |
| 4,688,643 | 8/1987 | Carter et al. | 222/175 X |
| 4,776,488 | 10/1988 | Gurzan | 222/107 X |
| 4,818,544 | 4/1989 | Seward . | |
| 4,848,660 | 7/1989 | O'Connell | 222/175 X |
| 4,948,023 | 8/1990 | Tripp | 222/175 X |

OTHER PUBLICATIONS

"Upstream" brochure—waterpacks, D. L. Johnson et al., Improved Flexible Container For Fluids, Research Disclosure, No. 218, Jun. 1982, 210-211, Havant, Hampshire, GB.

*Primary Examiner*—Kevin P. Shaver
*Assistant Examiner*—Kenneth DeRosa
*Attorney, Agent, or Firm*—Lawrence P. Trapani

[57] ABSTRACT

A portable, collapsible water tank suitable for use in combatting forest fires and the like that is manufactured from a flaccid synthetic material or a coated fabric which is capable of being ultrasonically welded. The bag is preferably made from a single sheet of material that is folded back upon itself to form a bag having uniformly sized front and rear panels. A filler assembly is mounted in the upper part of the front panel while a quick disconnect coupler is mounted in the lower part of the bag. The edge seams between the panel are welded closed using ultrasonic welding techniques. Radially extended skirts are provided about the bag outside of the seam areas and grommets are mounted within the skirts upon which shoulder straps and handles are either permanently removably secured. A hand-grip is welded to the front face of the tank beneath the filler assembly. The hand grip acts in conjunction with a handle attached to the top edge of the bag to allow the user to expand the tank to a fully opened position so that it can be rapidly filled to capacity.

10 Claims, 3 Drawing Sheets

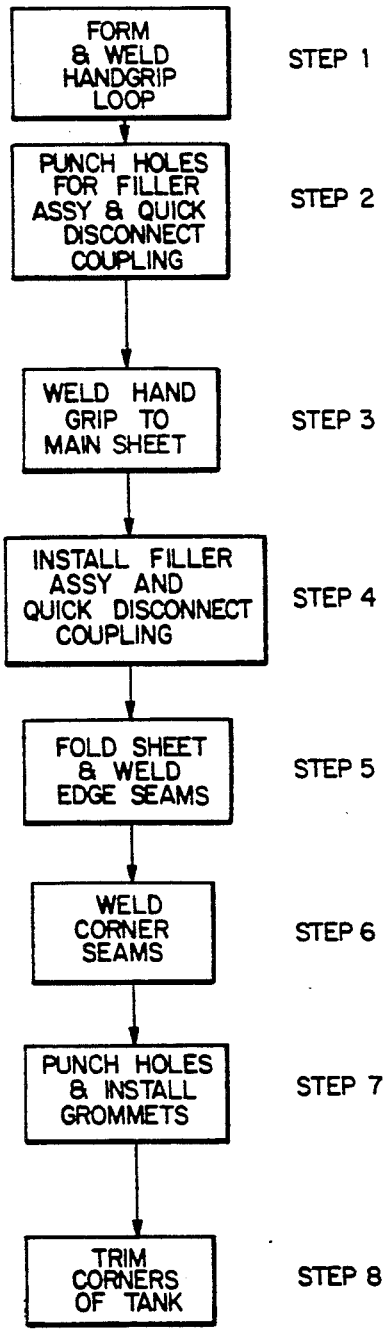
FIG. 6
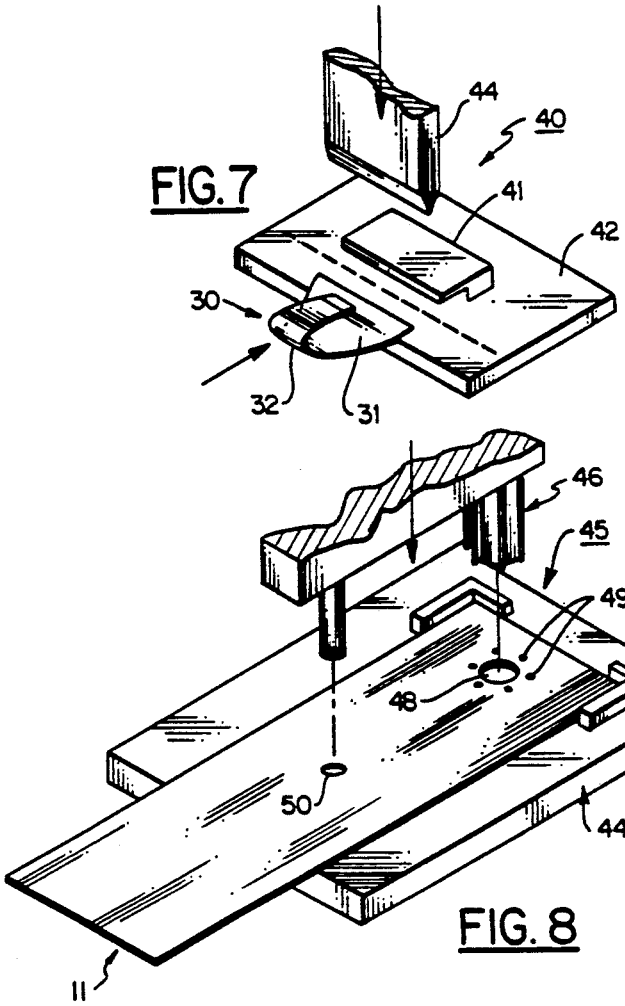
FIG. 7
FIG. 8
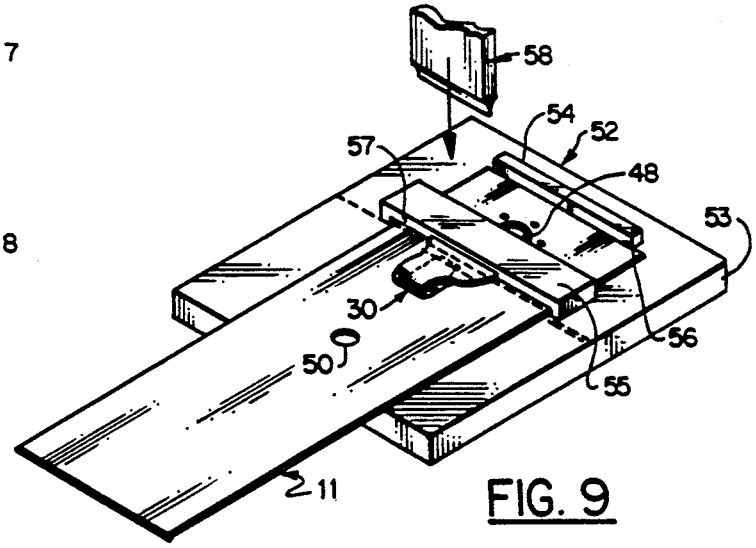
FIG. 9

COLLAPSIBLE WATER TANK

BACKGROUND OF THE INVENTION

This invention relates to a portable water tank made of a flaccid material that can be easily hand carried or backpacked by a firefighter when combatting forest fires, brush fires or the like.

Portable or backpackable water tanks that are capable of operating in association with hand-held pumps have been used by firefighters for quite some time in combatting remote forest or brush fires. The tanks are typically made of metal or a flaccid material, such as high strength neoprene, which allows the bag to be collapsed for easy storage when not in use. The collapsible tanks have a further advantage over their metal counterparts because they weigh less for a given capacity and are thus less tiring to carry. The collapsible tanks, however, are more difficult to handle in the field, particularly where they are being filled from lakes, ponds or other sources of water. The flaccid bags tend to remain in a collapsed condition when immersed in water and the wet bag is difficult to grasp and lift when it is filled to capacity.

Typically, collapsible water tanks are manufactured from one or more sheets of neoprene that are glued together at the seams to create a closed bag configuration. A filler hole having a closure cap is connected into the top section of the bag while a quick disconnect coupling is mounted in the bottom section thereof. A hand-held pump is attached to the coupling by which the firefighter can direct a spray of water upon a desired target. A carrying handle and a pair of shoulder straps are generally attached to the bag by means of tabs that are glued to the bag panels. The adhesive joints at the tabs and at the bag seams represent weak points in the bag construction which can fail, particularly when the bags become aged. Failure usually occurs during a fire fight, when failure can be least tolerated. Failure of the water bags can, under certain conditions, pose a danger to the firefighter's safety, and impair his or her ability to effectively combat the fire.

OBJECTS AND SUMMARY OF THE INVENTION

It is therefore an object of the present invention to improve portable, collapsible water tanks of the type presently used in combatting forest fires, brush fires and the like.

A further object of the present invention is to provide a collapsible water tank that can be backpacked or hand-carried, which contains high strength welded seams that will not open under actual field conditions.

A still further object of the present invention is to provide a collapsible, backpackable water tank having an all welded seam construction and peripheral skirts outside the weld areas to which carrying straps and handles can be securely affixed without adversely affecting the bag's water-tight integrity.

Another object of the present invention is to provide a transportable, collapsible water tank that can be quickly and easily expanded to a fully open position when immersed in a body of water to insure rapid filling thereof.

These and other objects of the present invention are attained by means of a portable, collapsible water tank suitable for use in combatting forest fires and the like that is manufactured from a synthetic material or a coated fabric which is capable of being ultrasonically welded. The bag is preferably made from a single sheet of material that is folded back upon itself to form a bag having uniformly sized front and rear panels. A filler assembly is mounted in the upper part of the front panel while a quick disconnect coupler is mounted in the lower part of the bag. The edge seams between the panel are welded closed using ultrasonic welding techniques to establish a high strength, water-tight structure. Peripheral skirts are provided about the bag outside of the seam areas and metal grommets are mounted within the skirts upon which shoulder straps and handles are either permanently or removably secured. A handgrip is welded to the front face of the tank beneath the filler assembly. The hand grip acts in conjunction with a handle attached to the top edge of the bag to allow the user to expand the tank to a fully opened position so that it can be rapidly filled to capacity. The hand-grip also allows the user to securely handle and transport the tank under all types of adverse conditions.

BRIEF DESCRIPTION OF THE DRAWINGS

For a better understanding of these and other objects of the present invention, reference will be made to the following detailed description of the invention which is to be read in association with the accompanying drawings, wherein:

FIG. 6 is a block diagram outlining the steps involved in the manufacture and assembly of the present tank; and FIGS. 7 through 14 further illustrate the operations involved in the manufacture and assembling of the present tank.

DETAILED DESCRIPTION OF THE INVENTION

Figure 1:
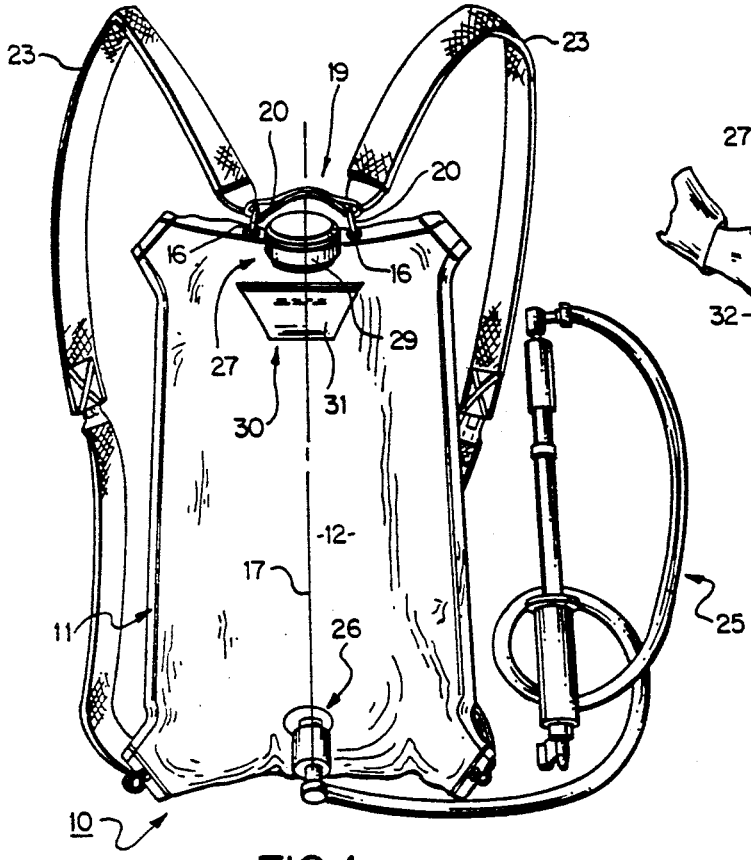
FIG. 1 is a front elevation of a portable, collapsible water tank embodying the teachings of the present invention which is equipped with removable shoulder straps and a hand operated pump unit.

Referring initially to FIGS. 1–5, there is illustrated a portable, collapsible tank, generally referenced 10, for holding a quantity of water or any other suitable liquid that embodies the teachings of the present invention. The tank is manufactured from a single sheet 11 of heavy duty waterproof material that is capable of being folded over upon itself to form a collapsible bag-like structure having a front panel 12 and a back panel 13 of equal size. The sheet material is further capable of being welded along the panel edge seams using well-known ultrasonic techniques, to provide a high-strength, water-tight tank that is capable of holding a quantity of water.

The four corners of the tank are diagonally cut at about a 45 degree angle to break the sharp corner edges and thus avoiding high localized wear stress in these critical areas. A relatively wide, generous skirt 14 is furnished along the top margin of the tank while equally generous corner skirts 15—15 are provided at the two lower corners thereof. A pair of metal upper grommets 16—16 are symmetrically mounted in the upper skirt about the vertical axis 17 of the tank. Similarly, metal grommets 18—18 are securely mounted in the lower corner skirts. The function of these metal grommets will be explained in detail below.

As illustrated in FIG. 1, a handle 19 is attached between the two upper grommets by means of metal rings 20—20 that pass through the grommet openings. Adjustable shoulder straps 23—23 of known construction are removably attached to the tank using snap-on clips or the like. In assembly, the left shoulder strap is connected between the upper and lower grommets located on the left-hand side of the tank as viewed in FIG. 1, while the right-hand shoulder strap is similarly mounted on the other side of the tank.

A conventional hand pump unit, generally referenced 25, is removably attached to the tank using a quick disconnect coupling 26 (FIG. 2) which is located in the lower section of the tank. The pump unit can be manually operated to draw water from the tank and direct it in a stream at a desired target.

A filler assembly 27 is centered on the axis of the tank in the top of the front panel 12. The filler assembly includes a raised neck section 28 (FIG. 2) that is adapted to lockingly receive a closure cap 29. A hand grip 30 is centrally welded to the front panel of the tank immediately below the filler assembly 27. The hand grip is constructed from a single piece 31 of tapered weldable material which is preferably the same material that is used to form the tank. The narrow end of the piece is turned back on itself to form a loop 32 and the edge of the loop is welded sonically to the back of the piece. The wider edge of the piece is welded to the front panel of the bag so that the loop is perpendicularly aligned with the axis of the tank and hangs down below the filler assembly.

Figure 2:
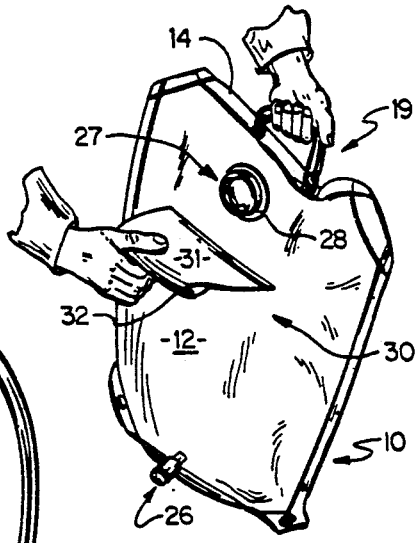
FIG. 2 is a perspective view of the tank shown in FIG. 1 with the shoulder straps and the pump unit removed.

The hand grip 30 serves a dual function not found in other collapsible tanks of the type presently used in the art. As noted above, filling a collapsible tank of this type by immersing it in a body of water has proven to be difficult because the bag will not fully open to allow the water to enter. As illustrated in FIG. 2, the handgrip 19 can be used in association with the hand grip 30 to pull the front panel of the tank away from the back panel, thus allowing water to freely enter the tank through the filler opening. The hand grip, in addition, allows the user to obtain a secure two-handed grip upon the tank so that it can be easily and securely handled under all types of adverse field conditions. Alternatively, an elongated member (not shown) can be passed through the loop 32 of the hand grip to aid in the carrying process. The hand grip also folds back against the front panel of the tank for easy space saving storage.

Turning now to FIGS. 6–14, the method of manufacturing and assembling the tank will be explained in greater detail. The tank is formed from a single sheet 11 (FIG. 8) of synthetic waterproof material, such as vinyl, or a coated fabric which is capable of being ultrasonically welded to create high strength, leak proof seams in the completed assembly. The steps involved in manufacturing and assembling the tank are shown in block diagram form in FIG. 6 and are explained in further detail with reference to the remaining figures.

The first step in the present manufacturing operation is to form the hand grip 30 into a loop configuration prior to welding it to the tank forming sheet 11. The hand grip, as noted above, is made of the same material as the tank body. A single piece 31 of this material is cut into a trapezoidal shape and the narrow end of the piece is turned back to form a loop 32 as shown in FIG. 7. The large end of the piece is passed under an L-shaped locating block 41 which is secured to the table of an ultrasonic welding machine, generally referenced 40. The large end of the hand grip piece is positioned and aligned against the block so that the loop of the hand grip lies beneath the movable welding head 44 of the machine. The head is brought down against the distal end of the loop and a closing seam is sonically welded between the two overlapping pieces at the narrow edge of the loop.

The main sheet 11 used to form the tank body is next placed within a punching fixture 45 and a die cutter unit 46 is brought down to form holes in the sheet for receiving the filler assembly 27 and the quick disconnect coupling 26(FIG. 1). These holes include the filler hole 48 and its associated rivet holes 49—49 along with a quick disconnect hole 50.(FIG. 8).

Once the holes have been formed in the main sheet, the sheet is placed in a second ultrasonic welding machine 52 and the hand grip 30 is welded securely to the front face of the sheet immediately below the filler hole 48. As seen in FIG. 9, the table 53 of the welding machine has a stop block 54 and a channel shaped hold down block 55 secured thereto. The top edge 56 of the sheet, which is located above the filler hole, is passed under the hold down block and is abutted against the stop block to align the sheet within the machine. The hand grip is then placed loop side down upon the face of the sheet and the wider edge of the hand grip is indexed against the front face 57 of the hold down block to properly align it under the welding head 58 of the machine. The head is then brought down against the top edge of the hand grip and a sonic weld is formed between the hand grip and the main tank sheet 11 to securely attach the hand grip to the sheet.

Figure 10:
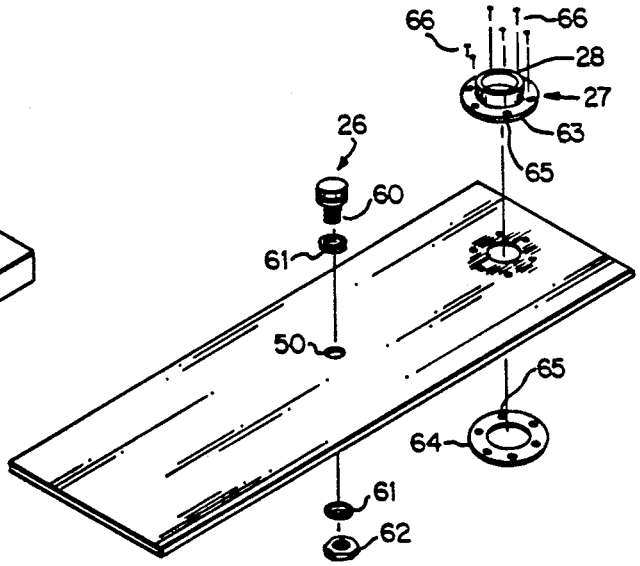

The sheet is then removed from the welding machine and the filler assembly 27 and the quick disconnect coupling 26 are mounted within the appropriate holes as shown in FIG. 10. The quick disconnect coupling has a threaded shank 60 that is adapted to pass through the hole 50. A pair of flat washers 61—61 are mounted upon the shank on either side of the sheet. A nut 62 is threaded onto the shank and tightened down to clamp the washers against the sheet with sufficient force to create a water tight joint therebetween. The filler assembly includes an outer flange 63 and an inner backing ring 64 having rivet holes formed therein. The flange and ring are placed over the filler hole 48 as illustrated in FIG. 10. The outer flange supports the raised neck section 28 of the assembly over filler hole 48. The neck is arranged to lockingly receive the closure cap as shown in FIG. 1. An adhesive bonding agent such as silicone, is placed between the main sheet and the abutting filler assembly parts to create a seal therebetween. Rivet holes 65—65 formed in the outer flange and the backing ring of the filler assembly are aligned with the holes 49—49 surrounding the filler hole 48. Rivets 66—66 are passed through the holes and the rivets are peeled over against the backing plate to secure the filler assembly to the sheet.

Figure 11:
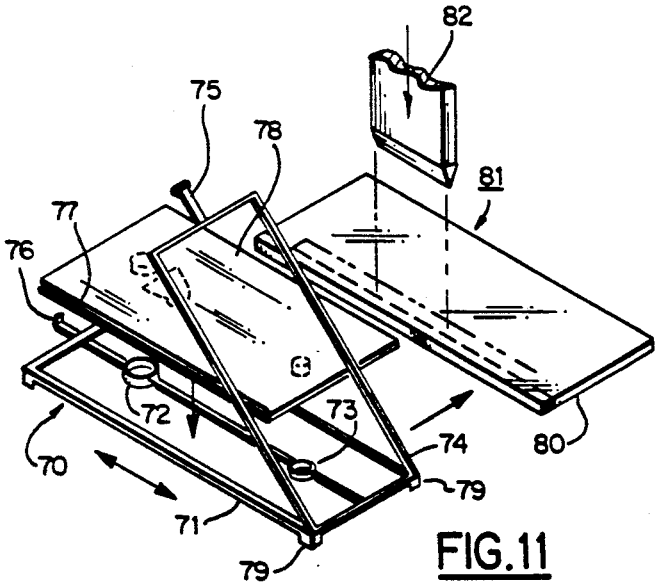

The sheet is now folded over upon itself and placed within a holding frame 70 (FIG. 11). The holding frame has a base plate 71 that contains locating holes 72 and 73 for slidably receiving therein the neck 28 of the filler assembly 27, and the quick disconnect coupling 26 and thus properly position the sheet within the frame. A hinged locking bracket 74 is brought down against the folded sheet and locked in place using mating clasp members 75 and 76. When the folded sheet is properly aligned and locked with in the frame, the two superimposed side edges 77 and 78 of the bag-like structure protrude an equal distance beyond the two side edges of the frame. The frame contains indexing lugs 79—79 which are secured to the base plate. The lugs are brought into registration against a table 80 of an ultrasonic welding machine 81 to properly position the side edge seams of the folded structure beneath the welding head 82 of the machine. Each side edge seam is welded by bringing the head down against the seam region. A number of passes are used to close each seam and thus bring the sheet into the desired tank configuration.

Figure 3:
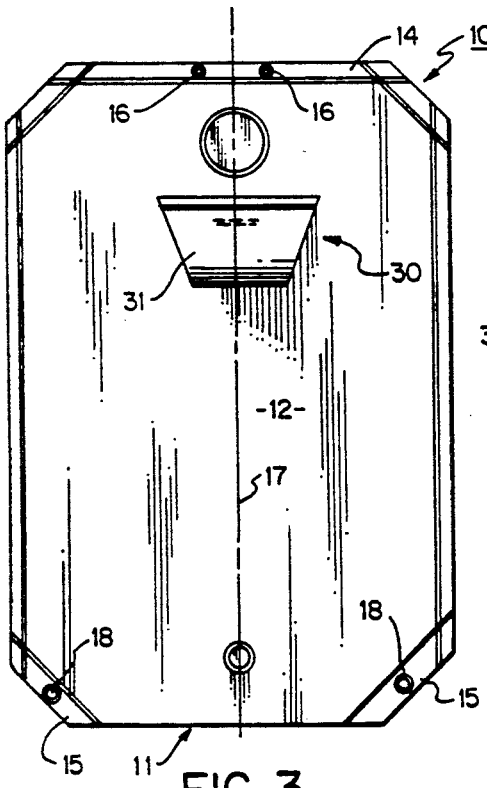
FIG. 3 is an enlarged front elevation of the tank shown in FIG. 2 with the filler assembly and the quick disconnect coupling removed.
Figure 4:
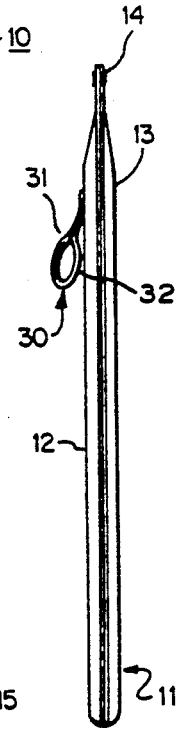
FIG. 4 is an end view of the tank shown in FIG. 3.
Figure 5:
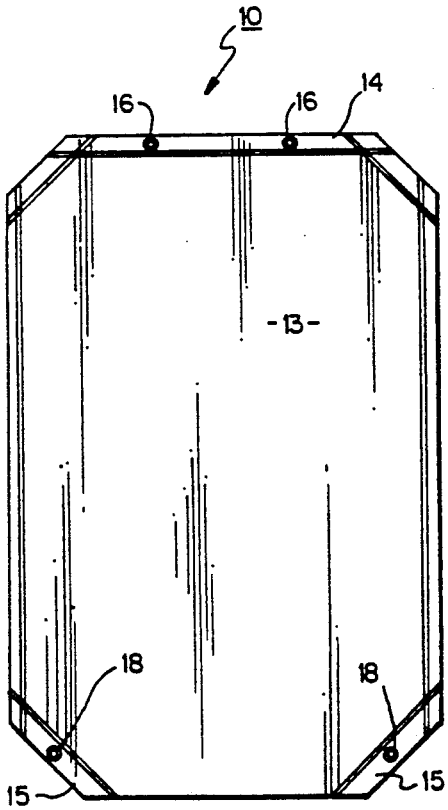
FIG. 5 is a back elevation of the tank shown in FIG. 3.
Figure 12:
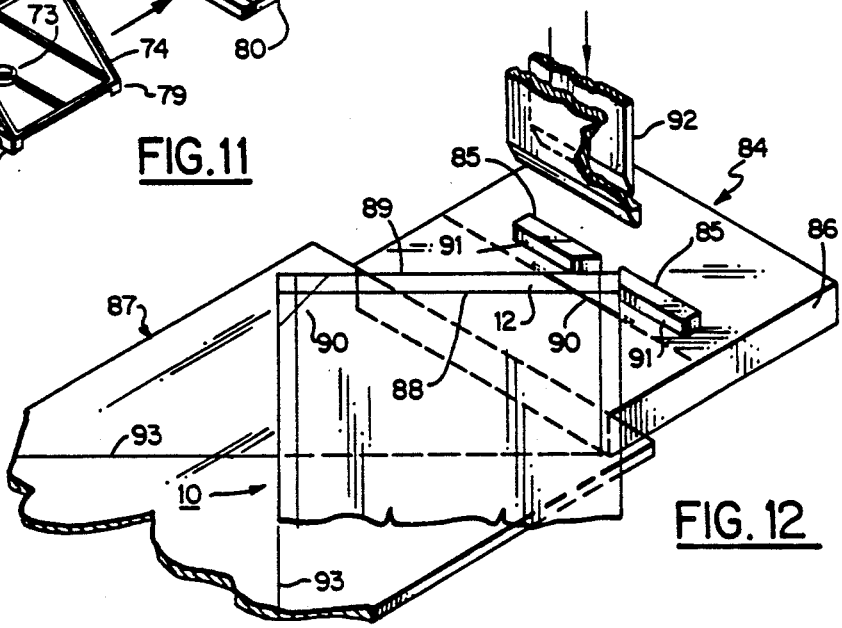

The tank is next brought to a final welding station that includes an ultrasonic welding machine 84 having two similar locating blocks 85—85 mounted on a table 86 in spaced apart relationship. The machine, in addition to the work table, includes a second auxiliary table 87 associated therewith. During the final welding operation, a top seam weld 88 is formed along the top edge 89 of the tank and diagonal seam welds 90—90 are formed along the four corners of the tank. Initially, the top edge of the tank is registered against the two front faces 91—91 of the registration blocks and the welding head 92 is brought down to weld the top seam. As previously noted, the top weld is positioned so that a relatively wide top skirt 14 is established along the upper margin of the tank. Here again, multiple welding passes may be required to complete the top seam. The tank is then turned at a forty-five degree angle and each corner is inserted between the blocks as shown in FIG. 12 to properly position the tank beneath the welding head. The head is then brought down to form diagonal welds in each corner. The diagonal welds pass directly over the previously formed side and top seam welds. Guide markers 93—93 are scribed on the auxiliary table to help align the corners within the work station. The diagonal welds are created so that relatively wide skirts 15—15 as shown in FIG. 3 are created outside of the corner weld areas. The purpose for these diagonal welds will become apparent from the disclosure below.

Figure 13:
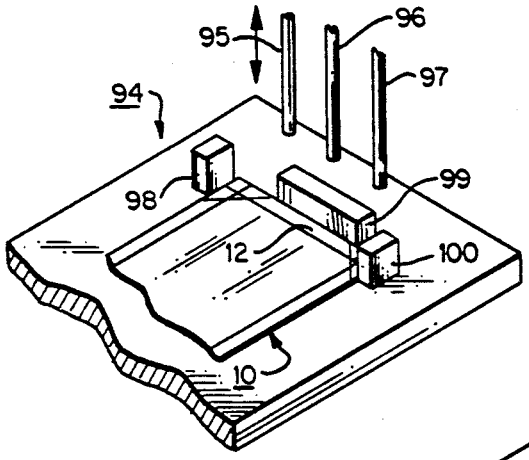

As illustrated in FIG. 13, the now completely welded tank is next processed in a die cutting machine 94 containing a series of cylindrical cutting pins 95—97. The pins are spaced apart so that pins 95 and 96 can be actuated to punch grommet holes in the top skirt 14 of the tank. Registration blocks 98 and 99 are positioned on the table of the punch press to align the top skirt of the tank beneath the cutting pins 95 and 96. In operation, the pins are brought down to punch the top holes within the skirt so that the holes are equally spaced on either side of the tank axis. Upon punching the top grommet holes, the tank is reversed within the punch press and the bottom edge of the tank indexed against blocks 99 and 100. At this time, cutting pins 95 and 97 are brought down into cutting contact with the two lower corners of the tank to create two additional lower grommet holes within the skirts region 15—15.

Although not shown, a two-piece metal grommet is inserted into each of the punched grommet holes and the grommet parts are mechanically crimped into locking contact against the skirt to secure the grommet in place. Any suitable crimping tool can be used for this purpose.

Figure 14:
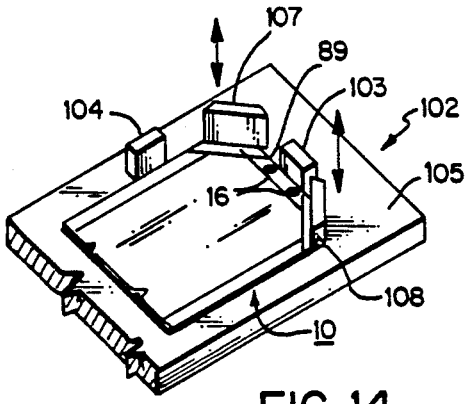

Lastly, the tank is placed within a cutting machine 102 as shown in FIG. 14 and the four corner sections of the tank are cut off at about a forty-five degree angle. Initially, the top edge 89 of the tank is indexed against registration blocks 103 and 104 carried on the work table 105 of the cutting machine. A pair of cutting dies 107 and 108 are brought down to trim the corner edges at the top section of the tank. The bag is then reversed and realigned within the indexing blocks and a second cutting operation is completed to trim the bottom corners. It should be noted that the cutting dies are set in the machine so that it will not disturb the metal grommets 18—18 previously set into the diagonal corner skirts 15—15.

Finally, the carrying handle and shoulder straps are connected to the tank using conventional connecting techniques to the grommets and the tank is ready for shipping and/or storage.

While this invention has been explained with reference to the structure disclosed herein, it is not confined to the details as set forth and this application is intended to cover any modifications and changes as may come within the scope of the following claims.

What is claimed is:

1. A collapsible tank suitable for use in combatting fires and the like that includes a sheet of flaccid sonically weldable material that is folded back upon itself to form a bag having a first panel, a second panel and edge seams between the panels, the first panel containing a filler hole through which liquid enters the interior of said bag, weld joints extending along the length of each edge seam to form water-tight joints between the two panels whereby a quantity of liquid can be stored in said bag, discharge means mounted in the bottom of said bag through which liquid stored in said bag is fed out of said bag, gripping means weld the first panel of said bag beneath the filler hole contained in the first panel of said bag, and handle means attached to the top of said bag above the filler hole contained in the first panel of said bag, whereby the panels can be separated by pulling said gripping means and said handle means in opposite directions to allow rapid filling of said bag through the filler hole.

2. The tank of claim 1 wherein the edge seams of said bag further include two side edge seams, a top edge seam, and diagonal cover edge seams located at two top corners and two bottom corners of said bag.

3. The tank of claim 2 wherein the weld joints are positioned substantially inside the edges of the panels to provide a radially extended top skirt along the top edge seam of said bag and a pair of radially extended corner skirts along the two diagonal cover edge seams at the bottom corners of said bag, said skirts being positioned outside the weld joints.

4. The tank of claim 3 that further includes first connector means mounted in the top skirt for attaching said handle means to said bag.

5. The tank of claim 4 that further includes second connector means mounted in the bottom corner skirts, and shoulder strap means removably attached between the first and second connector means whereby said tank is backpackable.

6. The tank of claim 5 wherein said connector means include grommets that pass through said skirts and are crimped into locking engagement therewith.

7. The tank of claim 1 wherein said bag further includes a filler assembly, said filler assembly having an outer flange with a raised neck section mounted on the outside of the first panel over the filler hole, an inner backing ring mounted on the inside of the first panel over the filler hole, rivet means for connecting the outer flange and inner backing ring to the first panel, and sealing means for providing a liquid-tight joint between said filler assembly and the first panel.

8. The tank of claim 7 wherein said filler assembly further includes a closure cap removably connected to the raised neck section of said outer flange.

9. The tank of claim 1 wherein said gripping means further includes a loop means that is arranged to hang down from the first panel of said bag beneath said filler assembly.

10. The tank of claim 1 wherein said bag further includes a filler assembly, said filler assembly having an outer flange with a raised neck section mounted on the outside of first panel over the filler hole, an inner backing ring mounted on the inside of the first panel over the filler hole, and rivet means for connecting the outer flange and inner backing ring to the first panel.

* * * * *

UNITED STATES PATENT AND TRADEMARK OFFICE

CERTIFICATE OF CORRECTION

PATENT NO. : 5,115,947

DATED : May 26, 1992

INVENTOR(S) : W. J. McDonnell, et. al.

It is certified that error appears in the above-indentified patent and that said Letters Patent is hereby corrected as shown below:

Column 6, line 40, "weld" should read --welded to --.

Column 8, line 11, after "of" insert --the--.

Signed and Sealed this

Seventh Day of September, 1993

Bruce Lehman

*Attest:*

BRUCE LEHMAN

*Attesting Officer*

*Commissioner of Patents and Trademarks*